US011509029B2

(12) United States Patent
Jing

(10) Patent No.: US 11,509,029 B2
(45) Date of Patent: Nov. 22, 2022

(54) RF DIELECTRIC WAVEGUIDE FILTER

(71) Applicant: CTS Corporation, Lisle, IL (US)

(72) Inventor: Dong Jing, Rio Rancho, NM (US)

(73) Assignee: CTS Corporation, Lisle, IL (US)

( * ) Notice: Subject to any disclaimer, the term of this patent is extended or adjusted under 35 U.S.C. 154(b) by 0 days.

(21) Appl. No.: 17/201,486

(22) Filed: Mar. 15, 2021

(65) Prior Publication Data

US 2021/0296747 A1 Sep. 23, 2021

Related U.S. Application Data

(60) Provisional application No. 62/991,204, filed on Mar. 18, 2020, provisional application No. 62/991,184, filed on Mar. 18, 2020.

(51) Int. Cl.

| | |
|---|---|
| ***H01P 3/16*** | (2006.01) |
| ***H01P 1/20*** | (2006.01) |
| ***H01P 7/10*** | (2006.01) |

(52) U.S. Cl.

CPC ..... *H01P 1/2002* (2013.01); *H01P 3/16* (2013.01); *H01P 7/10* (2013.01)

(58) Field of Classification Search

CPC ..... H01P 1/2002; H01P 1/20; H01P 1/201; H01P 1/207; H01P 1/208; H01P 1/2084; H01P 1/2086; H01P 1/2088; H01P 3/16; H01P 3/122; H01P 3/112; H01P 3/12; H01P 3/121; H01P 7/10; H01P 7/105

See application file for complete search history.

(56) References Cited

U.S. PATENT DOCUMENTS

2019/0067773 A1 2/2019 Vangala

FOREIGN PATENT DOCUMENTS

| | | |
|---|---|---|
| CN | 110459840 A | 11/2019 |
| CN | 110534849 A | 12/2019 |
| CN | 110556613 A | 12/2019 |
| CN | 110828948 A | 2/2020 |

OTHER PUBLICATIONS

CN110459840A Translation, Nov. 15, 2019 (Year: 2019).*

* cited by examiner

*Primary Examiner* — Stephen E. Jones

(74) *Attorney, Agent, or Firm* — Michael Best & Friedrich LLP

(57) ABSTRACT

A dielectric waveguide filter comprising a block of dielectric material including exterior surfaces covered with a layer of conductive material. A plurality of resonators are formed on the block. RF signal input/outputs are formed on the block. An RF signal is transmitted through the block in a serpentine pattern. In one embodiment, a RF signal transmission channel is formed in the block and extends between and surrounding selected ones of the plurality of resonators in a serpentine pattern. In one embodiment, selected ones of the plurality of resonators are comprised of respective islands of dielectric material formed on one of the top and bottom surfaces of the block of dielectric material surrounded by the channel and respective counter-bores formed and extending into the respective islands of dielectric material. In another embodiment, the respective islands of dielectric material and counter-bores defining the respective resonators are formed in opposed top and bottom surfaces of the block.

17 Claims, 5 Drawing Sheets

RF DIELECTRIC WAVEGUIDE FILTER

CROSS-REFERENCE TO RELATED AND CO-PENDING APPLICATIONS

This application claims the benefit of the filing date and disclosure of U.S. Provisional Application Ser. No. 62/991,184 filed on Mar. 18, 2021 and U.S. Provisional Application Ser. No. 62/991,204 filed on Mar. 18, 2021, the contents of which are entirely incorporated herein by reference as are all of references cited therein.

FIELD OF THE INVENTION

The invention relates generally to RF dielectric filters and, more specifically, to an RF dielectric waveguide filter with an interior RF signal channel.

BACKGROUND OF THE INVENTION

Various types of RF filters are known for filtering RF signals.

Ceramic monoblock filters are low cost, small in size and easy to manufacture. However, they have relatively high insertion loss, slow roll-off and low power handling capability.

Air cavity filters have low loss, fast roll-off, less spurious and high rejection However, they are usually large in size, heavy, and relatively expensive. Although air cavity filters can be made smaller, the performance degrades significantly as the size decreases.

Dielectric waveguide filters have good insertion loss, fast roll-off, high rejection and are relatively small in size. However, the dielectric waveguide filter spurious is high and very close to the passband of the RF signal. A fast roll-off lowpass filter is needed for regular dielectric waveguide filter. Dielectric waveguide filters with a loading at the center can push spurious further away at some cost of insertion loss.

The present invention is directed to a new lower weight and lower cost of manufacture RF dielectric waveguide filter with an interior RF signal channel formed in the body of the filter for pushing spurious and harmonic resonance modes to higher frequency without degrading of the quality factor Q.

SUMMARY OF THE INVENTION

The present invention is generally directed to a dielectric waveguide filter comprising a block of dielectric material including a plurality of exterior surfaces covered with a layer of conductive material, a plurality of resonators defined on the block of dielectric material, first and second RF signal input/outputs defined on the block of dielectric material, and one or more RF signal transmission channels formed in the material of the block of dielectric material and extending between selected ones of the plurality of resonators.

In one embodiment, the one or more channels form a continuous channel extending through the block of dielectric material in a serpentine pattern.

In one embodiment, the block of dielectric material includes opposed exterior top and bottom surfaces, selected ones of the plurality of resonators being comprised of respective islands of dielectric material formed on one of the top and bottom surfaces of the block of dielectric material and respective counter-bores formed and extending into the respective islands of dielectric material formed on the one of the top and bottom surfaces of the block of dielectric material.

In one embodiment, the one or more channels surround selected ones of the respective islands of dielectric material.

In one embodiment, the block of dielectric material includes opposed exterior top and bottom surfaces, selected ones of the plurality of resonators being comprised of respective islands of dielectric material formed on one of the top and bottom surfaces of the block of dielectric material and respective counter-bores formed and extending into the other of the top and bottom surfaces of the block of dielectric material in a relationship opposed to the respective islands of dielectric material.

In one embodiment, the block of dielectric material includes opposed exterior top and bottom surfaces, selected ones of the plurality of resonators being comprised of respective islands of dielectric material formed on one of the top and bottom surfaces of the block of dielectric material and the one or more open air channels surrounding selected ones of the respective islands of dielectric material.

In one embodiment, a pair of resonators are formed at one end of the block of dielectric material and a counter-bore positioned and spaced between the pair of resonators at the one end of the block of dielectric material.

In one embodiment, the one or more channels include one or more channel sections of varying width or depth for adjusting the coupling between the resonators.

In one embodiment, a plate covers the one or more channels formed in the material of the block of dielectric material.

In one embodiment, the plate is a printed circuit board defining RF signal input/output pads.

The present invention is also directed to a dielectric waveguide filter comprising a block of dielectric material including a plurality of exterior surfaces including opposed top and bottom surfaces covered with a layer of conductive material, a plurality of resonators defined on the block of dielectric material, first and second RF signal input/outputs defined on the block of dielectric material, a RF signal transmission channel formed in the dielectric material of the block of dielectric material and extending between selected ones of the plurality of resonators, and the plurality of resonators defined by one or more islands of dielectric material formed on one of the top and bottom surfaces of the block of dielectric material and surrounded by the channel.

In one embodiment, respective counter-bores are formed and extend into the respective islands of dielectric material formed on the one of the top and bottom surfaces of the block of dielectric material.

In one embodiment, respective counter-bores are formed and extend into the other of the top and bottom surfaces of the block of dielectric material in a relationship opposed to the respective islands of dielectric material.

The present invention is further directed to a dielectric waveguide filter comprising a block of dielectric material including a plurality of exterior surfaces including opposed top and bottom surfaces covered with a layer of conductive material, a plurality of resonators defined on the block of dielectric material, a plurality of slots extending through the block and separating the plurality of resonators, and RF signal input/outputs defined on the block of dielectric material, wherein the RF signal is transmitted through the block of dielectric and between the RF signal input/outputs in a serpentine pattern.

In one embodiment, a winding RF signal transmission channel is formed in the block of dielectric material and surrounds one or more of the plurality of resonators.

In one embodiment, one or more counter-bores are formed in the block of dielectric material and define one or more of the plurality of resonators, the channel surrounding the one or more counter-bores.

In one embodiment, an island of dielectric material surrounds the one or more counter-bores, the channel surrounding the island of dielectric material.

In one embodiment, the channel includes one or more channel sections of varying width.

In one embodiment, the filter further comprises a plurality of through-holes defined in the block of dielectric material and terminating in respective openings in the opposed top and bottom exterior surfaces of the block of dielectric material, the interior surface of the plurality of through-holes being covered with a layer of material having a dielectric constant higher than the dielectric constant of the layer of conductive material covering the plurality of exterior surfaces of the block of dielectric material.

Other advantages and features of the present invention will be more readily apparent from the following detailed description of the preferred embodiment of the invention, the accompanying drawings, and the appended claims.

BRIEF DESCRIPTION OF THE DRAWINGS

These and other features of the invention can best be understood by the following description of the accompanying Figs as follows.

DETAILED DESCRIPTION OF THE EMBODIMENTS

Figure 1:
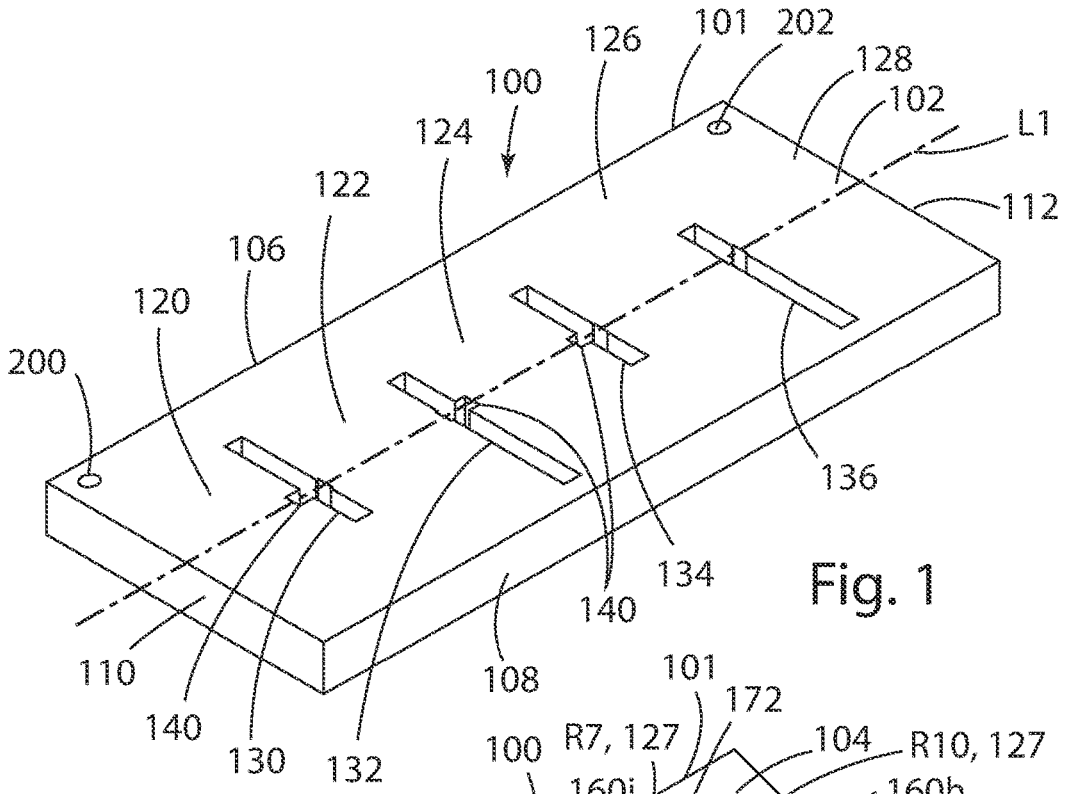
FIG. 1 is a top perspective view of an RF dielectric waveguide filter in accordance with the present invention.

FIGS. 1-4 depict an RF dielectric waveguide filter 100 in accordance with the present invention that is made from a generally parallelepiped-shaped solid block or core 101 of dielectric/ceramic material and includes opposed longitudinal horizontal exterior top and bottom surfaces 102 and 104, opposed longitudinal side vertical exterior surfaces 106 and 108 disposed in a relationship normal to and extending between the horizontal exterior top and bottom surfaces 102 and 104, and opposed transverse end side vertical exterior end surfaces 110 and 112 disposed in a relationship generally normal to and extending between the longitudinal horizontal exterior surfaces 102 and 104 and the longitudinal vertical exterior surfaces 106 and 108.

In the embodiment shown, each of the exterior surfaces 102, 104, 106, and 108 extends in the same direction as the longitudinal axis L1 of the filter 100 with each of the end exterior surfaces 110 and 112 extending in a direction transverse or normal to the direction of the longitudinal axis L1 of the filter 100.

The filter 100 includes a plurality of resonant sections or regions 120, 122, 124, 126, and 128 extending along the length of the block 101 of the filter 100 in a spaced-apart and generally parallel relationship relative to each other and further in a relationship generally transverse to the longitudinal axis L1 of the filter 100.

The plurality of resonant sections 120, 122, 124, 126, and 128 are separated from each other by a plurality of spaced-apart interior closed slits or slots or apertures or holes 130, 132, 134, and 136 comprising regions of the block 101 of the filter 100 which are devoid of dielectric material and extend vertically through the body of the block 101 and terminate in elongate openings in the top and bottom exterior surfaces 102 and 104 of the block 101 of the filter 100.

In the embodiment shown, the slots or apertures or through-holes 130, 132, 134, and 136 are closed, elongate and generally rectangular in shape. Although not shown in any of the Figs., it is understood that the slots or apertures or holes 130, 132, 134, and 136 may also extend and open into one or both of the exterior side surfaces 106 or 108 of the block 101 and may be of any other suitable shape or configuration including for example but not limited to one or more short closed circular openings or apertures or slots or holes located between the resonant sections 120, 122, 124, 126, and 128, or a combination of one or more short open and/or closed circular and oval holes, openings, apertures, or slots located between the resonant sections 120, 122, 124, 126, and 128.

In the embodiment shown, the slits or slots 130, 132, 134, and 136 extend in a relationship generally transverse or normal to and intersecting the longitudinal axis L1 of the filter 100 with the slit or slot 130 separating the resonant sections 120 and 122, the slit or slot 132 separating the resonant sections 122 and 124, the slit or slot 134 separating the resonant sections 124 and 126, and the slit or slot 136 separating the resonant sections 126 and 128.

Selected ones of the slits or slots 130, 132, 134, and 136 additionally define one or more hollow notches or fingers 140 protruding generally normally outwardly therefrom from one of the side surfaces thereof and protruding and extending into the dielectric material of the respective resonant sections 120, 122, and 124. The length of the slot extensions or fingers 140 can be increased or decreased to respectively decrease or increase the amount of dielectric material in the respective resonant sections 120, 122, and 124 for respectively decreasing or increasing the direct RF signal coupling between the resonators in the respective resonant sections 120, 122, and 124.

Each of the slits or slots 130, 132, 134, and 136 define respective bridges of dielectric material between respective ones of the ends of respective ones of the slits or slots 130, 132, 134, and 136 and respective ones of the side exterior longitudinal surfaces 106 and 108 and adapted to allow for the transmission of RF signals between the respective resonant sections 120, 122, 124, 126, and 128 in a generally serpentine or winding pattern as described in more detail below.

Figure 4:
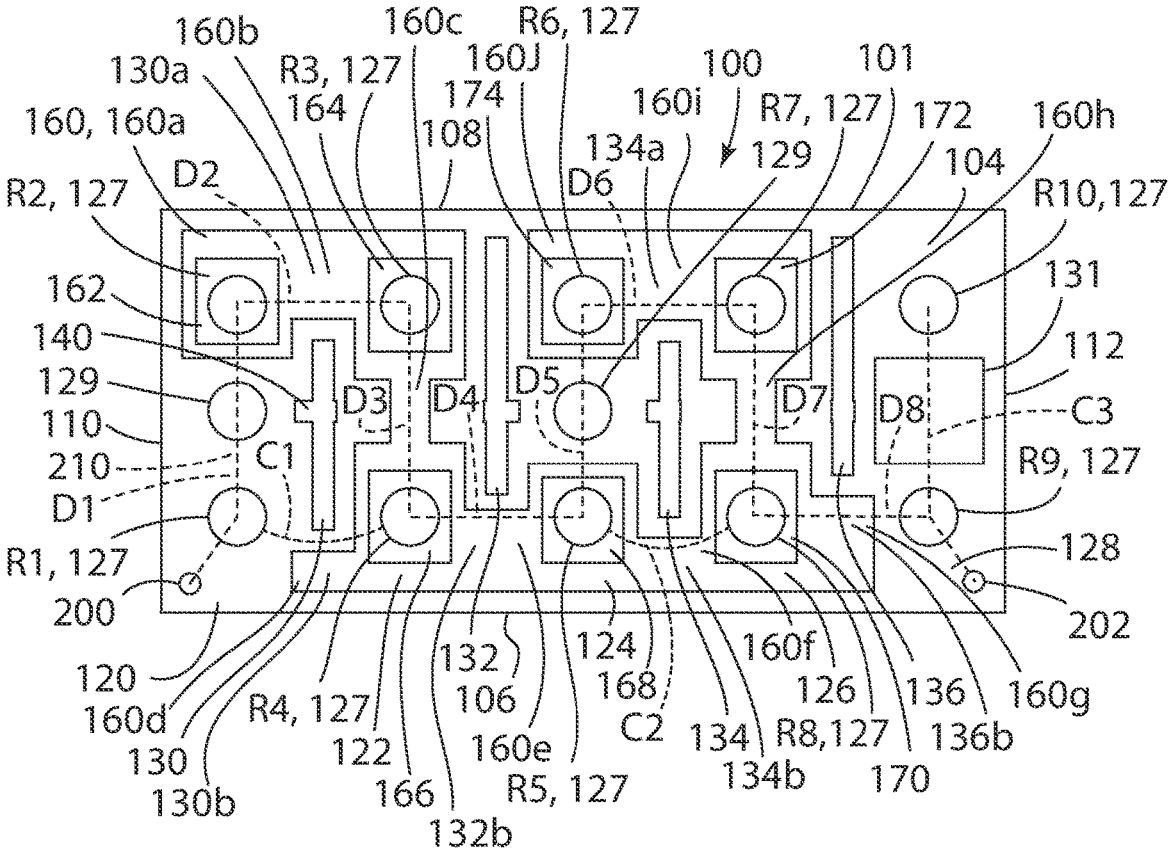
FIG. 4 is a bottom plan view of the RF dielectric waveguide filter of FIG. 1 which includes a depiction of the flow of the RF signal therethrough.

Specifically, and referring to FIG. 4, the slit or slot 130 defines opposed RF signal transmission bridges 130*a* and 130*b* located adjacent the opposed ends of the slit or slot 130 and, more specifically, between the respective opposed ends of the slit or slot 130 and the respective longitudinal side exterior surfaces 106 and 108 of the filter 100. The slit or slot 132 defines an RF signal transmission bridge 132*b* located between one of the ends of the slit or slot 132 and the longitudinal side exterior surface 108. The slit or slot 134 defines opposed RF signal transmission bridges 134*a* and 134*b* located adjacent the opposed ends of the slit or slot 134 and, more specifically, located between the opposed ends of the slit or slot 134 and the respective longitudinal side exterior surfaces 106 and 108. The slit or slot 136 defines an RF signal transmission bridge 136*b* located between one of the ends of the slit or slot 136 and the longitudinal side exterior surface 108.

It is understood that the length of respective ones or more of the slits or slots 130, 132, 134, and 136 can be increased or decreased to increase or decrease the width of the respective bridges and thus to increase or decrease the width of the respective RF signal transmission paths between the respective resonant sections 120, 122, 124, 126, and 128.

Figure 2:
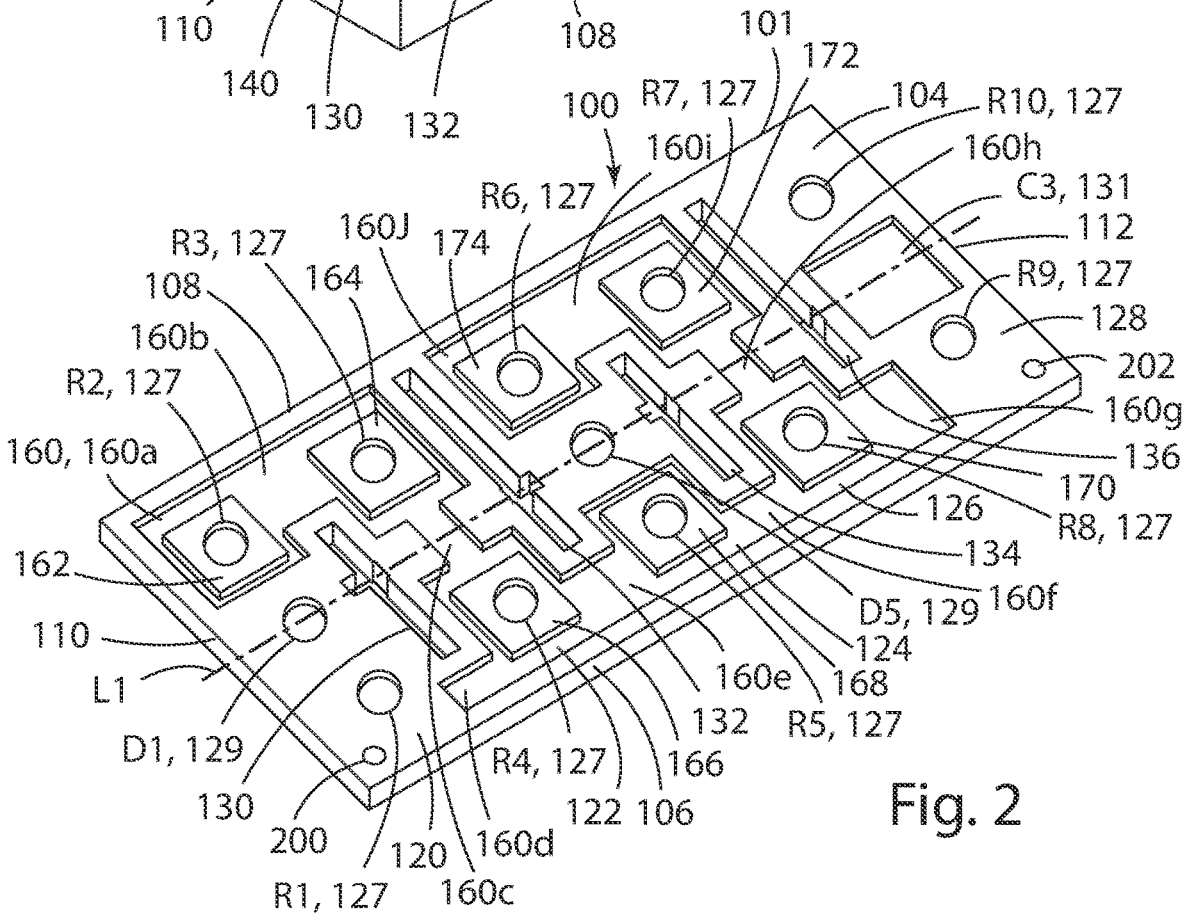
FIG. 2 is a bottom perspective of the RF dielectric waveguide filter shown in FIG. 1.

Referring to FIGS. 2 and 4, the resonant sections 120, 122, 124, 126, and 128 additionally define and include a plurality of resonators R1-R10 as described in more detail below. Each of the resonators R1-R10 comprises a region or cavity or hole or counter-bore 127 forming respective voids or recesses extending partially into, but not fully through, the dielectric material of the block 101 and terminating in respective openings in the bottom horizontal surface or face 104 of the block 101 of the filter 100. In the embodiment shown, each of the resonators R1-R10 is generally circular or tubular in shape.

Two resonators are located in each of the resonant sections 120, 122, 124, 126, and 128 in a relationship wherein respective pairs of resonators R1 and R2, R3 and R4, R5 and R6, R7 and R8, and R9 and R10 are positioned in a spaced-apart and co-linear relationship relative to each other at opposed ends of the respective resonant sections 120, 122, 124, 126, and 128 and further in a relationship adjacent and spaced from the respective longitudinal side exterior surfaces 106 and 108 of the block 101.

The resonant sections 120 and 124 additionally define a pair of regions or cavities or holes or counter-bores 129 forming voids or recesses extending partially into, but not fully through, the dielectric material of the block 101 and defining respective RF signal direct coupling structures or means or path D1 and D5 formed in the dielectric material of the block 101 of dielectric material and terminating in respective openings in the bottom horizontal exterior surface or face 104 of the block 101 of the filter 100.

In the embodiment shown, each of the inductive RF signal direct coupling structures or inductors D1 and D5 is generally circular or tubular in shape. One of the counter-bores 129 defining the RF signal direct coupling structure D1 is located in the center of the block 101 in a relationship intersecting the block longitudinal axis L1 and further in relationship located between and spaced from and co-linear with the resonators R1 and R2 in the resonant section 120. The other of the counter-bores 129 defining the RF signal direct coupling structure D5 is located in the center of the block 101 in a relationship intersecting the block longitudinal axis L1 and further in a relationship located between and spaced from and co-linear with the resonators R5 and R6 in the resonant section 124.

The resonant section 128 additionally defines a region or cavity or hole or counter-bore 131 forming a void or recess extending partially into, but not fully through, the dielectric material of the block 101 and defining an inductive RF signal cross-coupling structure or means or path or inductor C3 in the dielectric material of the block 101 and terminating in an opening in the bottom horizontal surface or face 104 of the block 101 of the filter 100. In the embodiment shown, the RF signal cross-coupling structure C3 is generally square shaped and located between and spaced from and co-linear with the resonators R9 and R10 in the resonant section 128 and intersecting the block longitudinal axis L1.

Referring to FIGS. 2 and 4, the block 101 additionally defines an elongate and winding and continuous and uninterrupted open air filled groove or recess or void or counter-bore or channel 160 formed therein and comprising an elongate open air filled region or channel of the block 101 which extends inwardly from the longitudinal bottom or lower exterior surface 104 of the block 101 partially into, but not fully through, the dielectric material of the block 101 in a continuous and uninterrupted winding and serpentine pattern and relationship as described in more detail below.

In the embodiment shown, the groove or recess or channel 160 comprises a continuous and uninterrupted region or channel 160 extending through the filter 100 and more specifically extending along the length of the block 101 from a point adjacent and spaced from the transverse side surface 110 in the direction of the opposed transverse side surface 112 and still more specifically through the respective filter resonant sections 120, 122, 124 and 126 as described in more detail below.

Although not shown in any of the Figs., it is understood that, depending on the desired application, the channel 160 may also comprise a plurality of discontinuous and interrupted regions or segments or channels.

Particularly, in the embodiment as shown in FIGS. 2 and 4, the elongate groove or recess or channel 160 extends through the block 101 as described in more detail below.

Initially, the groove or recess or channel 160 includes a first end or region 160*a* surrounding the resonator R2 and defining an island of dielectric material 162 surrounding the resonator R2.

The groove or recess or channel 160 includes a channel extension or region 160*b* unitary with the first end 160*a* and extending across the RF signal transmission bridge 130*a* into a relationship surrounding the resonator R3 and defining an island of dielectric material 164 surrounding the resonator R3. The channel extension 160*b* defines an RF signal direct coupling structure or means or path D2 in the dielectric material of the block 101 which allows for the direct coupling or transmission of the RF signal between the resonators R2 and R3.

The groove or recess or channel 160 further includes a channel extension or region 160*c* which is unitary with the channel extension 160*b* and extends between the resonators R3 and R4 into a relationship surrounding the resonator R4 and defining an island of dielectric material 166 surrounding the resonator R4. The channel extension 160*c* defines an RF signal direct coupling structure or means or path D3 in the dielectric material of the block 101 which allows for the direct coupling or transmission of the RF signal between the resonators R3 and R4.

Another channel extension or region 160*d* extends unitarily from the channel extension 160*c* and across the bridge

130*b* and defines an inductive RF signal cross-coupling structure or means or path or inductor C1 in the dielectric material of the block 101 which allows for the cross-coupling or transmission of the RF signal between the resonators R1 and R4.

A further channel extension 160*e* extends unitarily from the channel extension 160*c* across the RF signal transmission bridge 132*b* into a relationship surrounding the resonator R5 and defining an island of dielectric material 168 surrounding the resonator R5. The channel extension 160*e* defines an inductive RF signal direct coupling structure or means or path or inductor D4 in the dielectric material of the block 101 which allows for the inductive direct coupling or transmission of the RF signal between the resonators R4 and R5.

A still further channel extension or region 160*f* extends unitarily from the channel extension 160*e* across the RF signal transmission bridge 134*b* into a relationship surrounding the resonator R8 and defining an island of dielectric material 170 surrounding the resonator R8. The channel extension 160*f* defines an inductive cross-coupling structure or means or path or inductor C2 in the dielectric material of the block 101 that allows for the inductive cross-coupling or transmission of the RF signal between the resonators R5 and R8.

Another channel extension or region 160*g* extends unitarily from the channel extension 160*e* across the RF signal transmission bridge 136*b* and defines an inductive RF signal direct coupling structure or means or path or inductor D8 in the dielectric material of the block 101 that allows for the inductive direct coupling or transmission of the RF signal between the resonators R8 and R9.

Yet another channel extension or region 160*h* extends unitarily from the channel extension 160*f* between the resonators R8 and R7 into a relationship surrounding the resonator R7 and defining an island of dielectric material 172 surrounding the resonator R7. The channel extension 160*h* defines an inductive RF signal direct coupling structure or means or path or inductor D7 in the dielectric material of the block 101 that allows for the inductive direct coupling or transmission of the RF signal between the resonators R7 and R8.

Yet a further channel extension or region 160*i* extends unitarily from the channel extension 160*h* across the RF signal transmission bridge 134*a* into a relationship surrounding the resonator R6 and defining an island of dielectric material 174 surrounding the resonator R6. The channel extension 160*i* defines an inductive direct coupling structure or means or path or inductor D6 in the dielectric material of the block 101 that allows for the inductive direct coupling or transmission of the RF signal between the resonators R6 and R7.

One or more of the channel extensions may be of reduced or increased size including width or length or depth in relation to other sections or regions of the channel 160 including for example the channel extensions 160*b*, 160*c*, 160*h*, and 160*i* as shown in FIGS. 2 and 4 which are of reduced width relative to the other sections or regions of the channel 160.

The filter 100, and more specifically the block 101 thereof, further defines and includes a pair of RF signal input/output through-holes 200 and 202 extending through the body of the block 101 and terminating in respective openings in the top and bottom exterior surfaces or faces 102 and 104 of the block 101. The interior surface of the respective through-holes 200 are covered with a layer of metallization or conductive material and define respective RF signal input/output transmission electrodes.

In the embodiment in which the through-hole 200 defines the RF signal input electrode and the through-hole 202 defines the RF signal output electrode, the RF signal is transmitted through the filter 100 and more specifically the block 101 of the filter 100 as described in more detail below with reference to FIGS. 4 and 5.

Specifically, the RF signal, represented by the RF transmission line or path 210 in FIG. 4, is transmitted through the filter 100 in a generally serpentine or zig-zag or winding like pattern vertically through the resonant section 120 from RF signal input 200 and then between R1 and R2 through direct coupling D1; horizontally between R2 and R3 through the bridge 130*a* and direct coupling D2; vertically downwardly through the resonant section 120 between R3 and R4 through direct coupling D3; horizontally between R4 and R5 through the bridge 132*b*, channel extension 160*c* and direct coupling D4; vertically between R5 and R6 through direct coupling D5; horizontally between R6 and R7 through channel extension 160*i* and direct coupling D6; vertically between R7 and R8 through channel extension 160*h* and direct coupling D7; horizontally between R8 and R9 through channel extension 160*g* and direct coupling D8; vertically between R9 and R10 through cross-coupling C3; and then out through the RF signal input/output 202.

In accordance with the present invention, the use of the elongate groove or recess or channel 160 in selected or desired regions of the RF signal direct and cross-coupling paths which is filled with air results in the spurious and harmonic resonance modes being pushed to much higher frequency without degradation of quality factor Q and filter rejection is improved without degradation of insertion loss.

The use of the elongate groove or recess or channel 160 also results in a filter 100 with less dielectric material and of reduced weight which advantageously pushes spurious/harmonics further away from the RF signal passband due to reduced higher mode resonances.

The use of the elongate groove or recess or channel 160 also makes the filter 100 more tolerable to dielectric material variation because the RF signal direct and cross-coupling paths are filled with air instead of dielectric material.

In accordance with the present invention, the width and/or depth of the channel 160 and more specifically the width and/or depth of the respective channel extensions thereof can be increased or decreased to respectively decrease or increase the amount of dielectric material in the RF signal transmission path to respectively decrease or increase the direct coupling and indirect cross-coupling and transmission of the RF signal between the respective resonators.

It is further understood that, in the filter 100, all of the exterior surfaces of the block 101, the exterior surface of the respective islands of dielectric material 162, 164, 166, 168, 170, 172, and 174, the interior surfaces of the respective slits 130, 132, 134, and 136, the interior surfaces of the respective counter-bores 127, 129, and 131, and the interior surfaces of the respective input/output through-holes 200 and 202 are covered with a suitable conductive material including, for example, a silver material.

The exterior surface of the interior open channel 160 however is not covered with any conductive material and is comprised of a region of the exterior surface of the block 101 with exposed dielectric ceramic material and still, more specifically, a region of the block 101 and filter 100 with a dielectric constant lower than the conductive material covering the other regions of the block 101.

Figure 3:
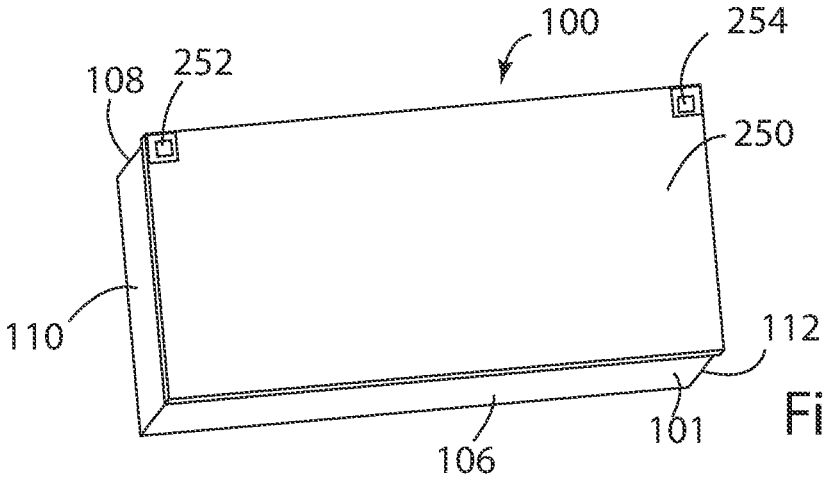
FIG. 3 is a bottom perspective view of the RF dielectric waveguide filter of FIG. 1 with a printed circuit board/plate coupled thereto.

The filter 100, as shown in FIG. 3, additionally comprises a cover or plate 250 which may be made of any suitable material or construction including for example ceramic, metal, or PCB material or construction and which covers and is coupled or attached to and against the bottom or lower exterior surface or face 104 of the block 101 in a relationship covering and enclosing the channel 160 and more specifically in a relationship creating and defining a closed RF signal transmission channel and region between the block 101 and the cover 250 which is filled or occupied with air.

In the embodiment shown, the cover 250 is in the form of a ceramic plate including RF signal input/output pads 252 and 254 adapted for contact with the respective RF signal input/output through-holes 200 and 202 defined on the block 101. Although not shown in the Figs., it is understood that the cover 250 can include openings adapted to provide access to the block 101 for tuning of the block 101.

Figure 5:
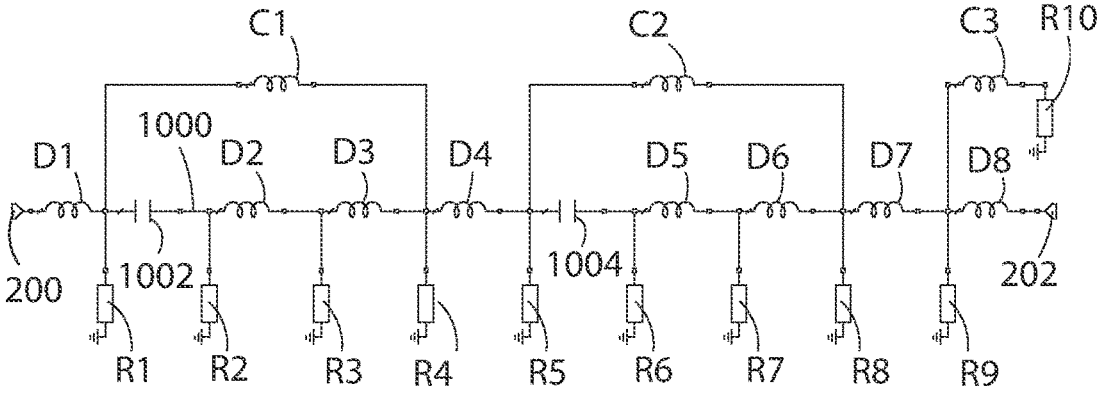
FIG. 5 is a schematic diagram of the electrical circuit of the RF dielectric waveguide filter of FIGS. 1-4.

FIG. 5 depicts the electrical RF signal path or circuit of the filter 100. In particular, the electrical RF signal path or circuit is comprised of a central RF signal path or line 1000 extending between the RF signal input/outputs 200 and 202. The line 1000 includes the plurality of inductors D1 through D8 coupled in series to each other. A capacitor 1002 on the line 1000 is coupled in series between the inductors D1 and D2 and a capacitor 1004 on the line 1000 is coupled in series between the inductors D4 and D5. The plurality of resonators R1 through R10 are coupled to the line 1000 between respective ones of the capacitors 1002 and 1004 and the plurality of inductors D1 through D8.

Particularly, R1 is coupled between D1 and capacitor 402, R2 is coupled between the capacitor 1002 and D2, R3 is coupled between D2 and D3, R4 is coupled between D3 and D4, R5 is coupled between D4 and capacitor 1004, R6 is coupled between capacitor 1004 and D5, R7 is coupled between D5 and D6, R8 is coupled between D6 and D7, R9 is coupled between D7 and D8, and R10 is coupled between D7 and D8. Moreover, inductor C1 is cross-coupled to the line 1000 and extends between the inductors D1 and D4, inductor C2 is cross-coupled to the line 1000 and extends between the inductors D4 and D7, and inductor C3 is cross-coupled to the line 1000 and extends between the inductors D7 and D8.

FIGS. 1-5 depict a first embodiment of the filter 100 wherein all of the elements of the respective resonators R1-R10, the direct couplings or inductors D1-D5, and the cross-couplings or inductors C1-C3 are formed in and extend into the dielectric material from the bottom or lower exterior surface or face 104 of the block 101 including specifically all of the counter-bores 127 and islands of dielectric material 162, 164, 166, 168, 170, 172, and 174 defining the respective resonators R2-R8, the counter-bores 129 defining the respective direct coupling means D1 and D5, and the elongate groove or recess or channel 160.

Stated another way, FIGS. 1-5 depict a first embodiment of the filter 100 in which the resonators R2-R8 are comprised of the combination of the respective islands of dielectric material 162, 164, 166, 168, 170, 172, and 174 and the respective counter-bores 127 are both defined and formed in and extending into the dielectric material from the bottom exterior surface 104 of the block 101 of the filter 100.

Figure 6:
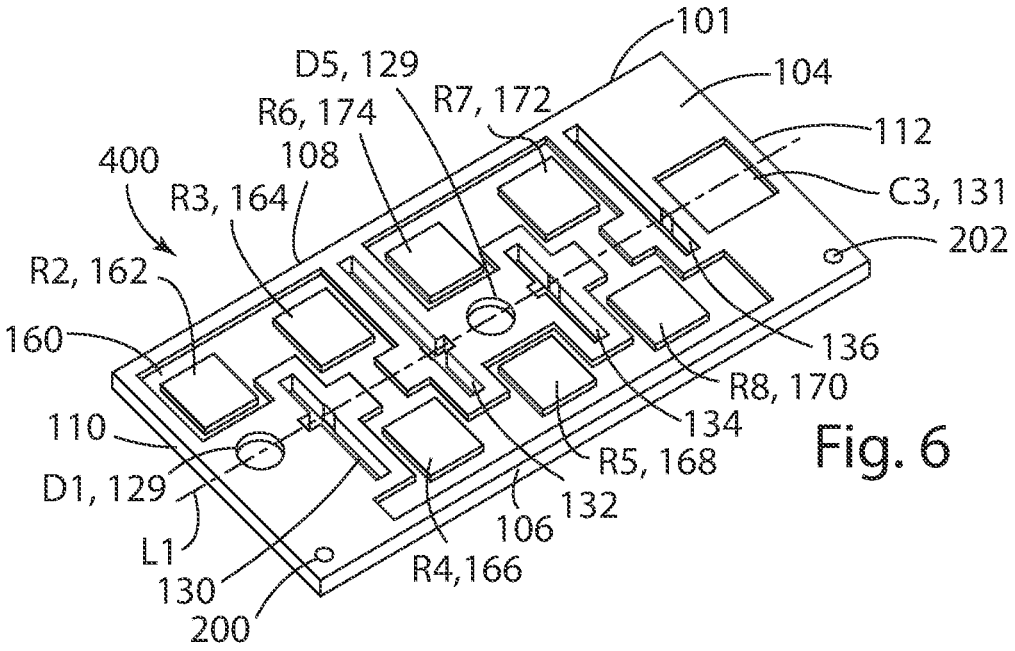
FIG. 6 is a bottom perspective view of another embodiment of an RF dielectric waveguide filter in accordance with the present invention.

FIG. 6 depicts another filter embodiment 400 which is similar in structure and function to the filter 100 shown in FIGS. 1-5 except that the resonators R2-R8 are comprised only of the respective islands of material 162, 164, 166, 168, 170, 172, and 174 formed in the dielectric material on the bottom exterior surface 104 of the block 101 and do not also include any counter-bores defined or formed therein as in the FIGS. 1-5 filter embodiment 100.

Figure 7:
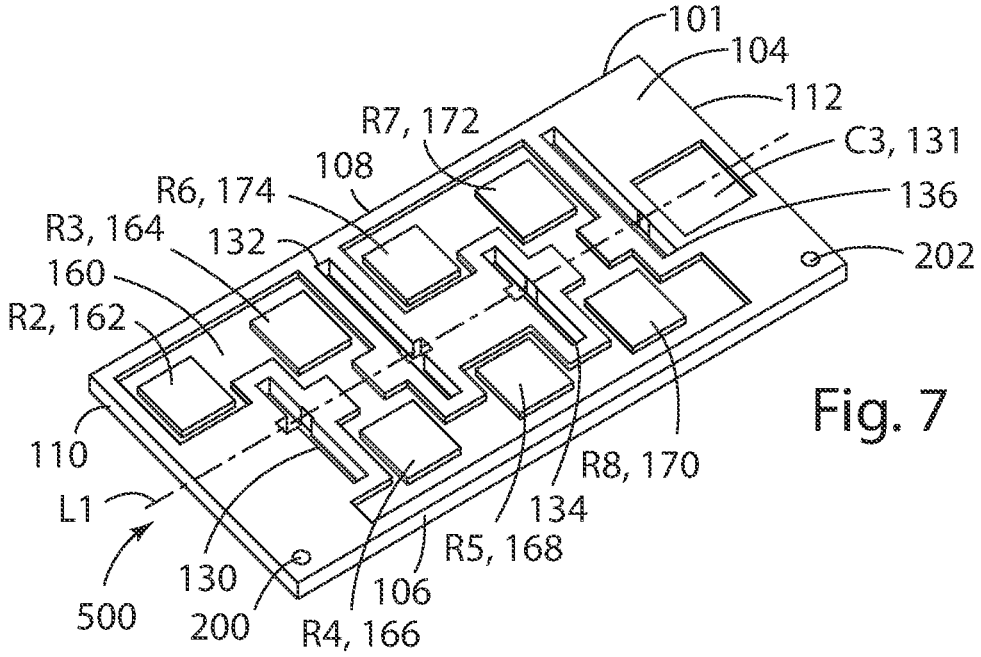
FIG. 7 is a bottom perspective view of a further embodiment of an RF dielectric waveguide filter in accordance with the present invention.

Additionally, the FIG. 7 embodiment 400 omits the resonators R1, R9, and R10. All of the other elements of the filter 400 are identical to the elements of the filter 100 and thus like numerals have been used in FIG. 7 and further the description of the identical elements, structure and function of the filter 100 is incorporated herein by reference with respect to the elements, structure and function of the filter 400 as though fully set forth herein.

Figure 8:
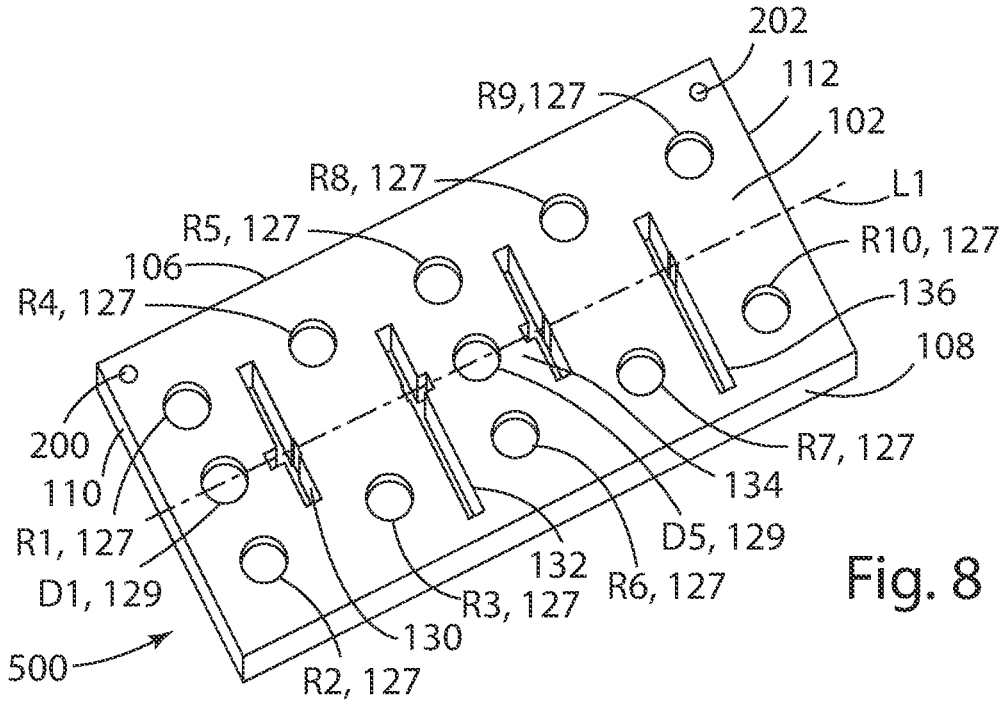
FIG. 8 is a top perspective view of the RF dielectric waveguide filter shown in FIG. 7.

FIGS. 7 and 8 depict a further filter embodiment 500 which is similar in structure and function to the filter 100 shown in FIGS. 1-5 except that all of the counter-bores 127 defining the respective resonators R1-R10 and the counter-bores 129 defining the respective direct couplings D1 and D5 are formed on and extend into the dielectric material in the top or upper exterior surface or face 102 of the block 101 rather than into the dielectric material in the bottom or lower exterior surface or face 104 of the block 101 as in the filter 100 shown in FIGS. 1-5.

Stated another way, in the filter embodiment 500 of FIGS. 7 and 8, the islands of dielectric material 162, 164, 166, 168, 170, 172, and 174 forming the respective resonators R2-R8 are formed in and extend inwardly into the dielectric material of the bottom exterior surface 104 of the block 101 while the respective counter-bores 127 forming the respective resonators R1-R10 and the counter-bores 129 forming the respective direct couplings D1 and D5 are formed in and extend inwardly from the dielectric material of the opposed top exterior surface 102 of the block 101 of the filter 100.

Still more specifically, the counter-bores 127 and the respective islands of dielectric material 162, 164, 166, 168, 170, 172, and 174 are positioned on the respective top and bottom exterior surfaces 102 and 104 in an opposed and co-linear relationship relative to each other.

All of the other elements and structure of the filter 500 are identical to the elements of the filter 100 and thus like numerals have been used in FIGS. 7 and 8 and further the description of the identical elements, structure, and function of the filter 100 is incorporated herein by reference with respect to the elements, structure and function of the filter 500 as though fully set forth herein.

Figure 9:
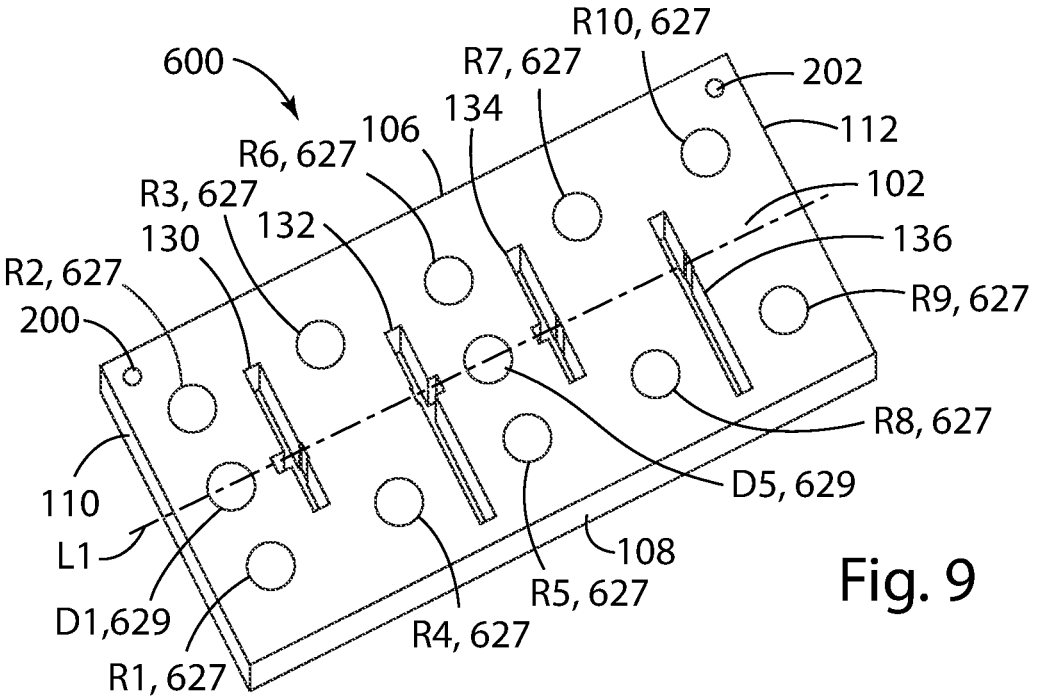
FIG. 9 is a top perspective view of a still further embodiment of an RF dielectric waveguide filter in accordance with the present invention.
Figure 10:
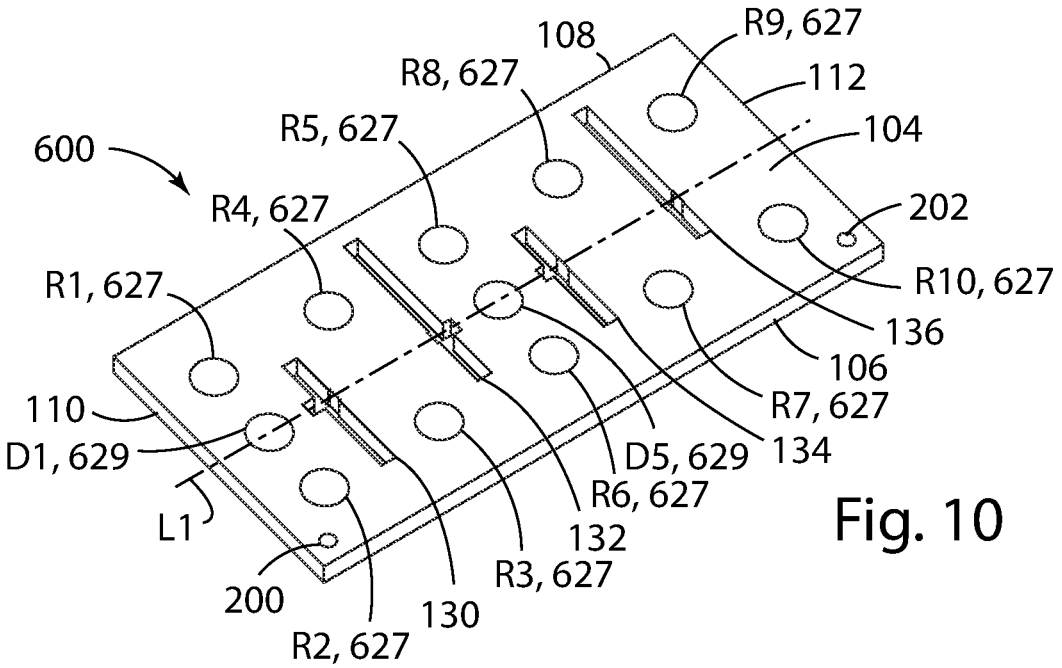
FIG. 10 is a bottom perspective view of the RF dielectric waveguide filter shown in FIG. 9.

FIGS. 9 and 10 depict a still further filter embodiment 600 which is similar in structure and function to the filter shown in FIGS. 1-5 except that all of the counter-bores 127 and 129 defining the respective resonators R1-R10 and the direct couplings D1 and D5 have been substituted with through-holes 627 and 629 extending through the body of the block 101 of dielectric material and terminating in respective openings in the top and bottom exterior surfaces or faces 102 and 104 of the block 101.

Moreover, in the embodiment of FIGS. 9 and 10, all of the exterior surfaces or faces 102, 104, 106, 108, 110, and 112 of the block 101 and the interior surfaces of the respective slots 130, 132, 134, and 136 are covered with a layer of metallization or conductive material having a low dielectric constant whereas each of the respective through-holes 627 and 629 are filled with a material having a dielectric constant higher than the dielectric constant of the material covering the exterior surfaces of the block 101 and the interior surfaces of the slots of the block 101.

Moreover, the FIGS. 9 and 10 filter embodiment 600 omits the following elements of the filter 100 of FIGS. 1-5: the interior channel 160, the islands of dielectric material 162, 164, 166, 168, 170, 172, and 174 surrounding the respective resonators R2-R8, and the counter-bore 131 defining the cross-coupling C3 which have been substituted with the through-holes 627 and 629 which define the plurality of resonators R1 through R10 in the FIGS. 9 and 10 filter embodiment and serve the same purpose and function as the omitted elements as described above with respect to the FIGS. 1-5 filter embodiment 100 and thus the earlier description in regard to the purpose and function of the omitted elements is incorporated herein by reference with regard to the purpose and function of the through-holes 627 and 629 of the FIGS. 9 and 10 filter embodiment 600.

Additionally, the description of the structure, function, and purpose of the elements in the FIGS. 1-5 embodiment with the same numerals in the FIGS. 9 and 10 embodiment is incorporated herein by reference with respect to the FIGS. 9 and 10 embodiment.

While the invention has been taught with specific reference to the embodiments shown, it is understood that a person of ordinary skill in the art will recognize that changes can be made in form and detail without departing from the spirit and the scope of the invention. The described embodiments are to be considered in all respects only as illustrative and not restrictive.

I claim:

1. A dielectric waveguide filter comprising:

a block of dielectric material including a plurality of exterior surfaces covered with a layer of conductive material;

a plurality of resonators defined on the block of dielectric material;

first and second RF signal input/outputs defined on the block of dielectric material; and one or more RF signal transmission channels formed in the material of the block of dielectric material and extending between selected ones of the plurality of resonators, wherein the block of dielectric material includes opposed exterior top and bottom surfaces, selected ones of the plurality of resonators being comprised of respective islands of dielectric material formed on one of the top and bottom surfaces of the block of dielectric material.

2. The dielectric waveguide filter of claim 1 wherein the one or more channels form a continuous channel extending through the block of dielectric material in a serpentine pattern.

3. The dielectric waveguide filter of claim 1 wherein the block of dielectric material includes respective counter-bores formed and extending into the other of the top and bottom surfaces of the block of dielectric material in a relationship opposed to the respective islands of dielectric material.

4. The dielectric waveguide filter of claim 1 wherein the one or more channels includes one or more open air channels surrounding selected ones of the respective islands of dielectric material.

5. The dielectric waveguide filter of claim 1 wherein the block of dielectric material includes respective counter-bores formed and extending into the respective islands of dielectric material formed on the one of the top and bottom surfaces of the block of dielectric material.

6. The dielectric waveguide filter of claim 5 wherein the one or more channels surround selected ones of the respective islands of dielectric material.

7. A dielectric waveguide filter comprising:

a block of dielectric material including a plurality of exterior surfaces covered with a layer of conductive material;

a plurality of resonators defined on the block of dielectric material;

first and second RF signal input/outputs defined on the block of dielectric material;

one or more RF signal transmission channels formed in the material of the block of dielectric material and extending between selected ones of the plurality of resonators; and a pair of resonators at one end of the block of dielectric material and a counter-bore positioned and spaced between the pair of resonators at the one end of the block of dielectric material.

8. The dielectric waveguide filter of claim 1 wherein the one or more channels include one or more channel sections of varying width or depth for adjusting the coupling between the resonators.

9. The dielectric waveguide filter of claim 1 further comprising a plate that covers the one or more channels formed in the material of the block of dielectric material.

10. The dielectric waveguide filter of claim 9 wherein the plate is a printed circuit board defining RF signal input/output pads.

11. A dielectric waveguide filter comprising:

a block of dielectric material including a plurality of exterior surfaces including opposed top and bottom surfaces covered with a layer of conductive material;

a plurality of resonators defined on the block of dielectric material; first and second RF signal input/outputs defined on the block of dielectric material;

a RF signal transmission channel formed in the dielectric material of the block of dielectric material and extending between selected ones of the plurality of resonators; and the plurality of resonators defined by one or more islands of dielectric material formed on one of the top and bottom surfaces of the block of dielectric material and surrounded by the channel.

12. The dielectric waveguide filter of claim 11 further comprising respective counter-bores formed and extending into the respective islands of dielectric material formed on the one of the top and bottom surfaces of the block of dielectric material.

13. The dielectric waveguide filter of claim 12 further comprising respective counter-bores formed and extending into the other of the top and bottom surfaces of the block of dielectric material in a relationship opposed to the respective islands of dielectric material.

14. A dielectric waveguide filter comprising:

a block of dielectric material including a plurality of exterior surfaces including opposed top and bottom surfaces covered with a layer of conductive material; a plurality of resonators defined on the block of dielectric material;

a plurality of slots extending through the block and separating the plurality of resonators;

RF signal input/outputs defined on the block of dielectric material;

a winding RF signal transmission channel formed in the block of dielectric material and surrounding one or more of the plurality of resonators; and one or more counter-bores formed in the block of dielectric material and defining one or more of the plurality of resonators, the channel surrounding the one or more counter-bores, wherein the RF signal is transmitted through the block of dielectric and between the RF signal input/outputs in a serpentine pattern.

15. The dielectric waveguide filter of claim 14, wherein an island of dielectric material surrounds the one or more counter-bores, the channel surrounding the island of dielectric material.

16. The dielectric waveguide filter of claim 14, wherein the channel includes one or more channel sections of varying width.

17. The dielectric waveguide filter of claim 14, further comprising a plurality of through-holes defined in the block of dielectric material and terminating in respective openings in the opposed top and bottom exterior surfaces of the block of dielectric material, the interior surface of the plurality of through-holes being covered with a layer of material having a dielectric constant higher than the dielectric constant of the layer of conductive material covering the plurality of exterior surfaces of the block of dielectric material.

* * * * *